US006481587B2

(12) United States Patent
Higgins

(10) Patent No.: US 6,481,587 B2
(45) Date of Patent: Nov. 19, 2002

(54) PENDANT-SUPPORTED TELESCOPING BOOM CRANE

(76) Inventor: David J. Higgins, 715 Mt. Zion Rd., NE., Resaca, GA (US) 30735

( * ) Notice: Subject to any disclaimer, the term of this patent is extended or adjusted under 35 U.S.C. 154(b) by 87 days.

(21) Appl. No.: 09/819,498

(22) Filed: Mar. 28, 2001

(65) Prior Publication Data

US 2001/0045405 A1 Nov. 29, 2001

Related U.S. Application Data

(60) Provisional application No. 60/192,518, filed on Mar. 28, 2000, and provisional application No. 60/268,182, filed on Feb. 13, 2001.

(51) Int. Cl.[7] ..... B66C 23/04

(52) U.S. Cl. ..... 212/298; 52/118; 212/231; 212/348

(58) Field of Search ..... 212/298, 231, 212/347, 348, 349; 52/118

(56) References Cited

U.S. PATENT DOCUMENTS

| | | | | |
|---|---|---|---|---|
| 1,481,351 A | | 1/1924 | Cochran | |
| 1,611,326 A | | 12/1926 | Abbe | |
| 2,688,411 A | * | 9/1954 | Bushong et al. | 212/298 |
| 2,905,280 A | * | 9/1959 | Weaver | 52/118 |
| 3,125,227 A | | 3/1964 | Kaufman et al. | |
| 3,977,530 A | | 8/1976 | Helm et al. | |
| 4,133,411 A | | 1/1979 | Curb | |
| 4,156,331 A | | 5/1979 | Lester et al. | |
| 4,166,542 A | | 9/1979 | Bryan, Jr. | |
| 4,168,008 A | | 9/1979 | Granryd | |
| 4,327,533 A | | 5/1982 | Sterner | |
| 4,352,434 A | | 10/1982 | Poock | |
| 4,383,616 A | | 5/1983 | Sterner | |
| 4,460,098 A | | 7/1984 | Scherman | |
| 4,467,928 A | | 8/1984 | White | |
| 4,557,391 A | | 12/1985 | Poock et al. | |
| 5,135,118 A | | 8/1992 | Koizumi | |
| 5,597,078 A | | 1/1997 | Becker et al. | |
| 5,678,708 A | | 10/1997 | Forsberg et al. | |
| 5,799,807 A | | 9/1998 | Humme | |
| 5,884,791 A | * | 3/1999 | Vohdin et al. | 212/348 |
| 6,062,405 A | | 5/2000 | Pech et al. | |
| 6,089,388 A | | 7/2000 | Willim | |

OTHER PUBLICATIONS

Demag Mobile Cranes website pages printed out on Mar.6, 2001, pp. 1–6.

* cited by examiner

*Primary Examiner*—Thomas J. Brahan
(74) *Attorney, Agent, or Firm*—Gardner Groff & Mehrman, P.C.

(57) ABSTRACT

A telescoping boom crane having a multi-sectioned, telescopically extending boom and an extensible pendant support system. The extending boom includes boom sections that are extensibly receivable within the adjacent boom section. The boom sections are made of a sheet material. A releasable locking mechanism may be attached to the boom sections to secure the boom sections.

The extensible pendant support system includes a plurality of pendants. The pendants are extensibly receivable within an adjacent pendant. The pendant support system at least partially supports the boom when a load is applied to the boom. Further, the support system may include a forestay length locking device functioning to prohibit extension of a subsequent pendant from an adjacent pendant once the former pendant achieves an extended position.

36 Claims, 14 Drawing Sheets

PENDANT-SUPPORTED TELESCOPING BOOM CRANE

CROSS-REFERENCE TO RELATED APPLICATIONS

This application claims priority to U.S. Provisional Patent Application Serial No. 60/192,518 filed on Mar. 28, 2000, and U.S. Provisional Patent Application Serial No. 60/268,182 filed on Feb. 13, 2001 entitled "Improved Retractable Load Bearing Boom".

FIELD OF THE INVENTION

The present invention is directed to a telescoping boom crane having a multi-sectioned, telescopically extending boom.

BACKGROUND OF THE INVENTION

Extremely heavy lifts and/or long-reach lifts have previously required the transportation in pieces, assembly and erection of pendant supported latticed boom cranes. The telescoping boom crane is normally more readily transportable, will erect with less time, labor and equipment and in a more confined space.

The present invention is especially useful as a boom for a mobile crane. Mobile cranes are lifting machines, capable of being moved around or between work sites. Manufacturers and users of the mobile crane must typically balance certain criteria such as total machine weight, cost, mobility, boom length and the net load lifting capacity of the machine, when selecting a crane. As an example, as a boom is made longer or stronger, it normally must be made heavier. The heavier boom requires a heavier, more expensive, less mobile structure to support it. Significant advantage can be achieved by use of a strong but light boom, capable of achieving longer telescoping ranges while maintaining rigidity of the boom under load.

As it turns out, the currently available crane capable of best balancing these criteria are boom cranes commonly referred to as the lattice boom cranes. These cranes feature pendant supported booms, which are hauled to the jobsite in sections and pinned together to achieve the desired boom length.

Lattice boom cranes are the best modern technology has been able to achieve for extremely heavy, extremely long-reach and long term, fast-paced production lifting. Unfortunately, the lattice boom cranes continue to suffer some serious drawbacks:

a) It is time consuming and expensive to move a lattice boom crane or change the boom length. Typically another crane, a crew of men, and a number of trucks to haul boom sections are required.

b) A large amount of clear ground and overhead area is required for assembly and disassembly of the crane sections. Many industrial plants and city construction sites simply do not have sufficient clear area necessary to assemble and tilt the boom up into a working position.

c) Assembly and disassembly of the crane has proven to be one of the most dangerous phases of crane operations. Many deaths and injuries occur each year by simple errors made in the manual pinning and/or unpinning procedure used for attaching boom sections and pendants together.

d) Typical supporting wire rope pendants have a relatively short safe life span. The wire rope pendants are cumbersome to handle. They are connected by dozens of pins with keepers, each critical. Frequent inspections for deterioration and correct assembly are required to be made by highly trained and diligent personnel.

e) The boom is very expensive to manufacture. Each section is made of dozens of cut and welded parts, which must be fitted exactly to insure true and straight sections.

Some problems with lattice boom cranes have been somewhat alleviated with the introduction of the telescoping boom cranes which began to appear more prevalently in the 1950's. As the name implies, the telescoping cranes are fit with a boom made of multiple sections which nest one within the other. During transport between work sites, these cranes typically travel with the boom in a stowed or retracted position. Upon arrival on site, the boom may be quickly raised, then extended, ready to lift the load.

Unfortunately, this increased mobility comes with heretofore unsolvable drawbacks. One specific problem keeping the telescoping boom crane from making long and/or heavy lifts is the greater relative mass of the telescoping crane boom. Advances in mass reduction while retaining or increasing the strength and/or length of the telescopic crane boom have slowly decreased to incremental improvement over the last few decades. As compared to lattice booms, the telescoping booms have traditionally been subjected to significant bending stress from both the ram used to raise and lower the boom, as well as the load extending from the end of the boom. The lattice booms, on the other hand, are supported by a pendant system. Typically, the pendants are fastened to the upper end of the boom and to a mast well above the base of the boom and then the pendants are pulled upon in order to raise the boom. Axial compression forces are thereby placed on the boom, but very little bending occurs. Further, under load, the pendant system additionally provides support to that offered by the lattice structure itself. Simply substituting the lattice boom pendant system onto a telescopic crane would have its own complications in that it would require, among other considerations, a crew to erect and dismantle the system, transportation of the system and adequate space within which to erect and extend the boom.

The problems associated with currently available telescoping boom cranes are summarized as follows:

a) The boom is comparatively heavy, thereby causing a corresponding increase in the weight of the support structure needed to support it. Overall, the mobile crane is heavier, but can only lift lighter loads, especially as the load is moved further from the machine, (e.g. through extension of the boom).

b) The boom is very flexible, especially as the length increases. Flexibility causes problems with load positioning and control, and further expands cycle times on production jobs. Further, the difficulty associated with controlling a load hanging from a long, flexible boom tip causes increased operator stress and fatigue.

c) The booms are too short for many jobs.

d) The cranes lose capacity rapidly as the load radius (distance from machine) increases.

e) The cranes lose capacity rapidly as the boom length is increased.

f) The booms are expensive to build, typically requiring two or more full-length welds on rather heavy gauge material and considerable weldments and machining on both ends and at various intermediate positions for reinforcing, pin locking and adjustable slides.

Attempts to furnish pendant support for telescoping booms have been made. The SUPERLIFT by Demag Mobile Cranes, GmbH, is a system whereby wire rope is reeved through a mast and the boom tip. It typically features a large winch on the side of the boom, which tends to block the operator's view, adds weight, and requires additional hydraulic circuitry. The pendant support provided on the SUPERLIFT is wire rope, which has a poor safe working-load-to-weight-ratio, a short life-span and requires frequent inspection by a skilled person. The SUPERLIFT has many sheaves or rollers which must be kept lubricated and inspected. Most importantly, the pendant support of the SUPERLIFT has not served to significantly lighten or lengthen the telescoping boom it supports, but is normally used as an add-on and erected only for extra-heavy lifts.

The present invention avoids these and other difficulties by providing an extending boom capable of lifting heavy loads.

SUMMARY OF THE INVENTION

The present invention is directed to a telescoping boom crane having a multi-sectioned, telescopically extending boom and an extensible pendant support system. The extending boom includes boom sections that are extensibly receivable within the adjacent boom section. The extensible pendant support system includes a plurality of pendants that are extensibly receivable within an adjacent pendant. The pendant support system at least partially supports the boom when a load is applied to the boom.

More particularly, the extending boom includes at least two boom sections: a tip boom section and a base boom section. Additionally, at least one intermediate boom section may be situated between the tip and base boom sections. The boom sections have successively smaller cross-sections and are extensibly receivable within the adjacent boom section. Each of the boom sections is made of a sheet material, which may or may not have corrugations, perforations or both, extending along a length of the sheet material. Further, the boom sections are columnar in shape. Lastly, a releasable locking mechanism may be attached to the boom sections to secure each of the boom sections and maintain positional relationship of the boom sections when the sections are in a fully extended position.

The extensible pendant support system includes a plurality of pendants including at least a tip pendant and a base pendant. Additionally, at least one intermediate pendant may be situated between the tip and base pendants. Each of the pendants is extensibly receivable within an adjacent pendant, and extension of the extending boom causes extension of the extensible pendant support system such that the extensible pendant support system at least partially supports the extending boom when a load is applied to the boom. The plurality of pendants may additionally form a forestay, which may be utilized with a mast and a backstay to form the extensible pendant support system. Further, the support system may include a forestay length locking device functioning to prohibit extension of a subsequent pendant from an adjacent pendant once the former pendant achieves an extended position.

It is further contemplated herein that the multi-sectioned, telescopically extending boom and the extensible pendant support system according to one embodiment of the present invention may be utilized in a partially extended configuration. Further a mechanism for telescopically advancing the boom sections may be provided.

BRIEF DESCRIPTION OF THE DRAWINGS

As used herein, like numerals throughout the various figures represent the same or equivalent features of the present invention.

DETAILED DESCRIPTION OF THE PREFERRED EMBODIMENT

The present invention provides an improved telescoping crane that is less weighty than those currently available and capable of reaching longer lengths. The present invention is directed to a telescoping boom crane having a multi-sectioned telescopically extending boom, such as those typically used in a mobile crane. The present invention is useful for mobile load supporting towers, tower cranes, mobile construction cranes, and the like, or any parts thereof, including the jib, mast, boom, boom extension, and the like. The telescopically extending boom is formed from at least two sections: a tip boom section and a base boom section. The telescopically extending boom may further be formed from at least one intermediate boom section situated between tip boom section and the base boom section. The telescoping boom crane further includes an extensible pendant support system. (As used herein, to assert that the components are "extensible", it will be understood that the components are also retractable.)

Figure 1:
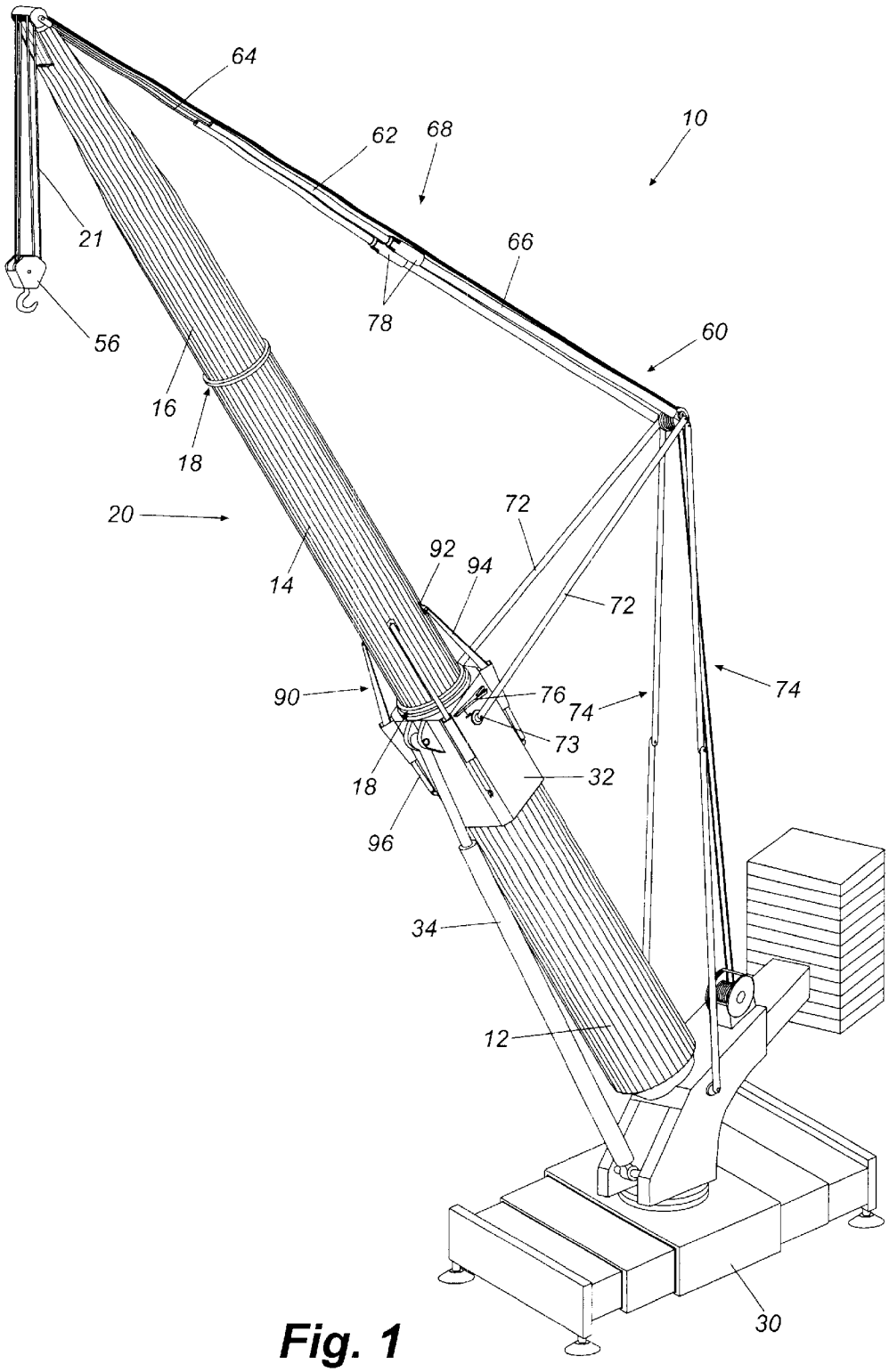
FIG. 1 is a perspective view of an exemplary crane using the extending boom and extensible pendant support system according to one embodiment of the present invention.
Figure 24:
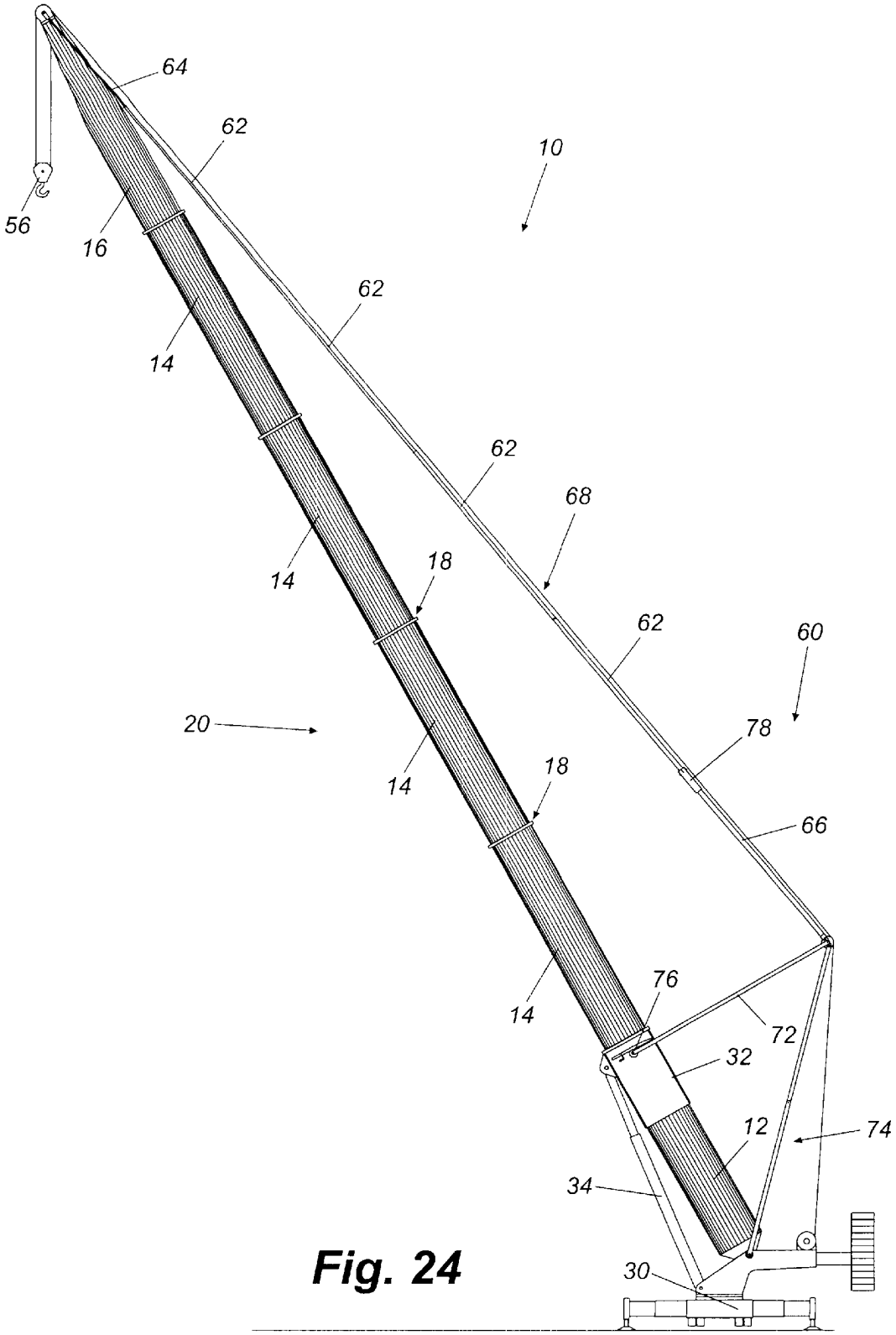
FIG. 24 is a side view of a telescoping boom crane according to one embodiment of the present invention.

With reference to FIGS. 1 and 24, the telescoping boom crane 10 according to one embodiment of the present invention, having a hook block 56, shown attached to a base or support structure 30, such as a chassis or rotating deck, includes a multi-sectioned, telescopically extending boom 20. Of the multiple boom sections, the telescopically extending boom 20 includes a base boom section 12 that is not extensible, and a tip boom section 16. The base boom section 12 is typically mounted to the support structure 30 and a structural frame 32, which is attached to a base boom hoist cylinder 34.

Additionally, the telescopically extending boom 20 may include at least one intermediate boom section 14. The tip boom section 16, and each of the intermediate boom sections 14 when used, is extensibly receivable within its adjacent boom section. In order that each adjacent boom section be capable of nesting within or being extensibly receivable within its adjacent boom section, it is necessary that the boom section have a smaller cross section than the adjacent boom section. Also, it is possible to attach wear pads 85 (see FIG. 15*a*) to the boom sections to facilitate easy extensibility and retractability of the boom sections.

Figure 17:
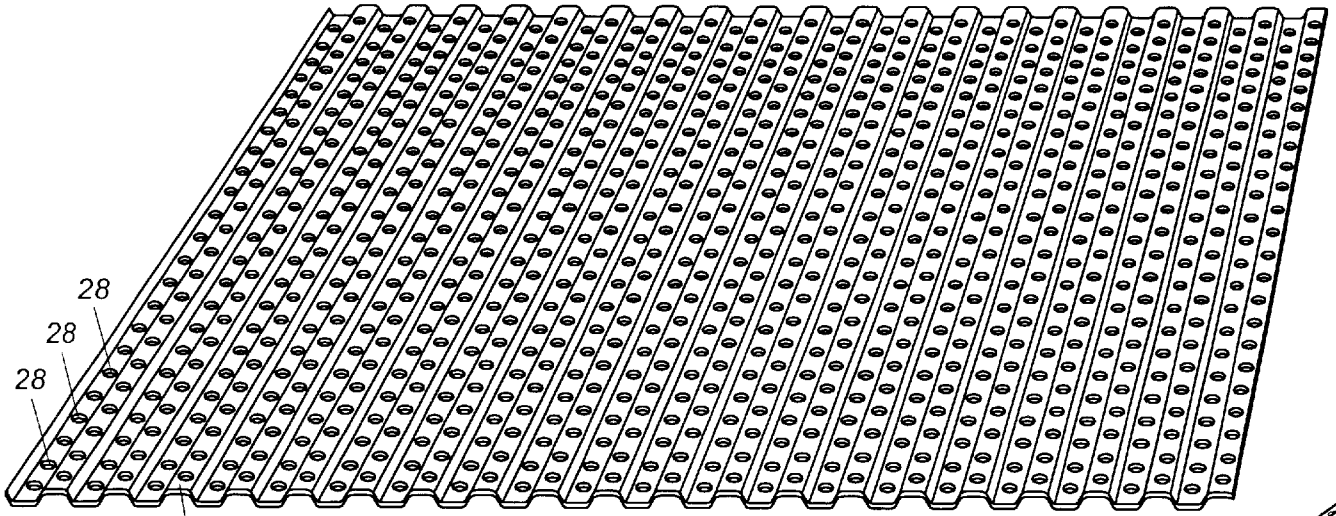
FIG. 17 is a perspective view of a sheet material having perforations according to one embodiment of the present invention.
Figure 19:
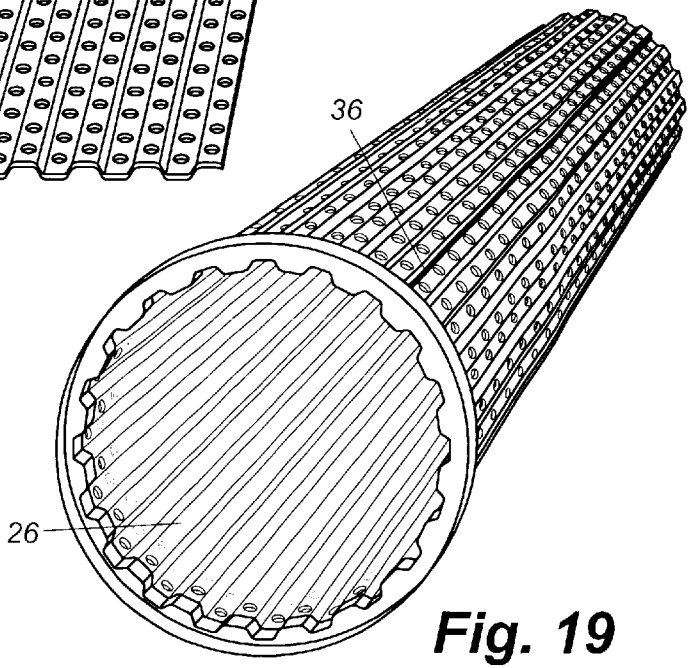
FIG. 19 is a perspective view of the sheet material of FIG. 17 after it has been formed into a boom section.
Figure 18:
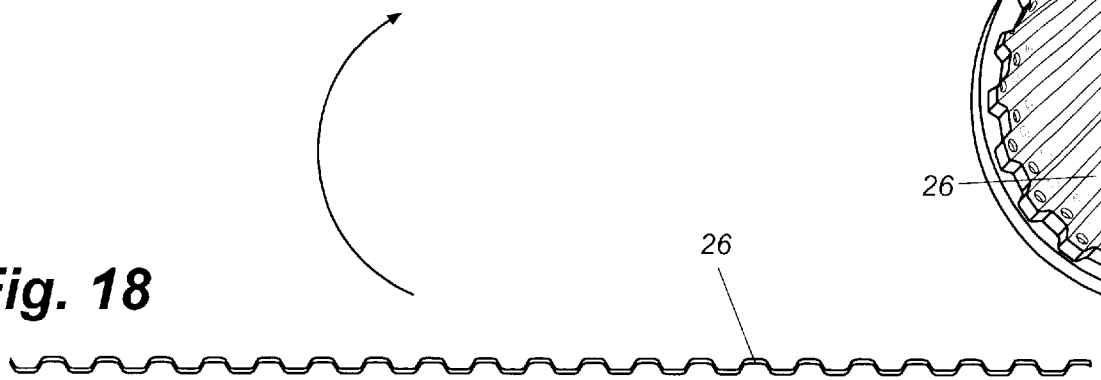
FIG. 18 is a side view of the sheet material of FIG. 17 being rolled into a boom section.

Each of the boom sections is made from at least one sheet material. The sheet material 26 according to the present invention may include a single sheet that is shaped to form the boom sections as can be seen in FIGS. 17–19. Of the many ways to shape the sheet material, as contemplated herein, folding, bending, rolling, and any combination thereof, may be employed.

Figure 2:
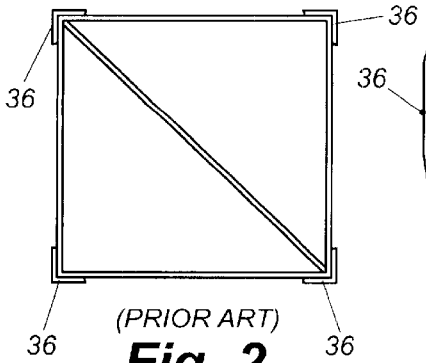
FIGS. 2–5 are cross-sectional top views of a boom section according to the prior art.

In fact, it is possible to form the boom sections according to the present invention from a single sheet material, (or single layer), by grasping the material along its opposing lateral edges and folding or bending the material to bring the edges together. The edges may be joined by any mechanism known by those skilled in the art. According to the present invention, welding the edges together is extremely effective. In fact, a single weld 36, as shown in FIGS. 6–13 and 19, forming a joint between the opposing lateral edges to maintain the shape of the individual boom sections is most satisfactory in that it is easily accomplished and requires a minimal amount of welding material, (as compared to the prior art boom sections). In FIG. 2, a cross-sectional view is shown of a typical prior art lattice crane boom. Such boom sections are of the conventional trussed or so-called laced construction of square or rectangular cross-sectional design and embodying transversely and vertically spaced top and bottom longitudinal beams, which may be tubular in form, connected by oblique lacing bars. In each of the figures, it can be seen that multiple welds 36 are used (and necessary) to form these structures. Such welding is time consuming, expensive and adds weight. It is known that lattice boom cranes having extendable booms are designed to be supported by pendants and loaded in axial compression. Because of the lacing or latticework, lattice booms are not favorable to telescoping. Each successive section would be significantly smaller than the one within which it is nested. Because the stress on the extended boom is nearly equal from the tip to the base of a pendant supported boom, it is advantageous that the boom sections be nearly equal in size to match the applied stress.

The sheet material used to form the boom sections according to the present invention includes a material having sufficient strength and rigidity to endure application of the load. Exemplary of such suitable sheet materials include, but are not limited to, metal, plastic, expanded metal, and a composite material. The term "expanded metal" as used herein, is that definition ascribed by those of ordinary skill in the art and includes such materials as grating and floor plate material. As for the term "composite material", this material includes any multi-layered material, typically one that is both lightweight and has sufficient strength as described above, including, but not limited to, layers of metal, plastic, polymer sheets, carbon fiber sheets, glass fiber sheets, KEVLAR as available from E.I. du Pont de Nemours and Company, and the like, and any combinations thereof.

As further contemplated herein, the sheet material 26 includes a perforated material as can be seen, for instance, in FIG. 17. Of course it will be understood that a material with perforations 28 is mostly beneficial in that it reduces the overall weight of the extending boom but must be selected so as not to compromise the structural integrity of the boom.

Moreover, the sheet material according to one embodiment of the present invention is one that is capable of being formed and/or folded into corrugations as can be seen in the various figures. Although it is contemplated that each of the boom sections includes a sheet material that has corrugations extending along a length of the sheet material, it may be possible to form some boom sections without the corrugations. For instance, the base boom section of FIG. 25 does not include corrugations because it is additionally supported by a structural frame 32.

The corrugations may take many forms including folds of parallel and alternating ridges and grooves as can be seen, for instance, in the cross-sectional views of the boom sections shown in FIGS. 6–13. Of course, exemplary of such acceptable configurations include that the corrugations could have deep or shallow ridges and grooves; could have two alternating deep and shallow ridges or grooves; and could have sharply angled ridges or rounded ridges. The corrugations on these boom sections may be very pronounced resulting in increased stiffness and greater stability of the boom section. This design allows much narrower flat areas, thus allowing a thinner material to be used while maintaining the required width/thickness ratio, as discussed in more detail below. The present invention contemplates any and all combinations of corrugations.

Figure 6:
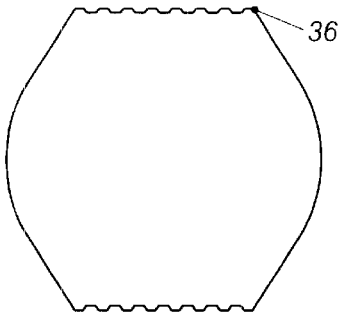
FIGS. 6–13 are cross-sectional top views of a boom section according to the embodiment of FIG. 1.
Figure 7:
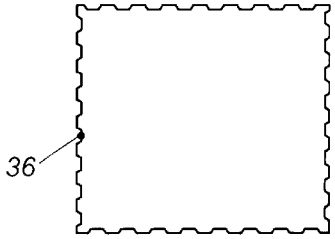
Figure 8:
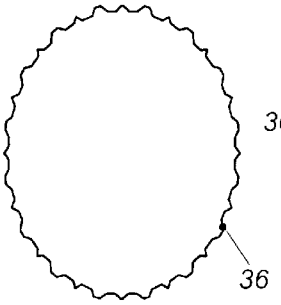
Figure 9:
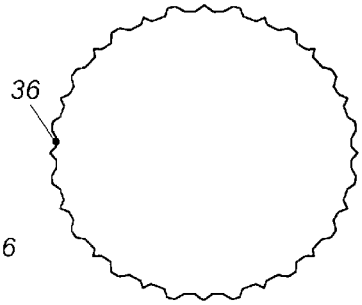
Figure 10:
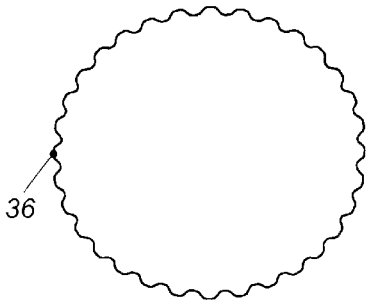
Figure 11:
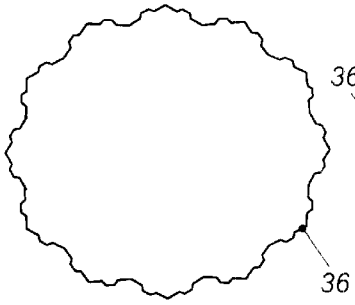
Figure 12:
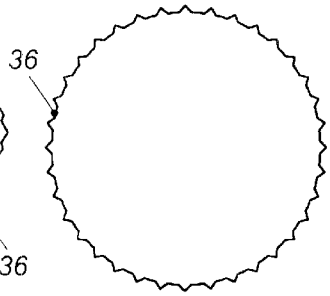
Figure 13:
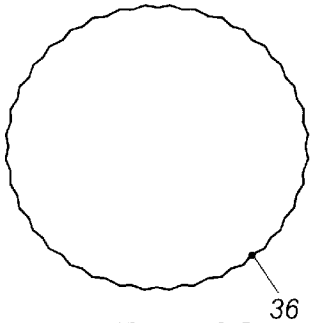

One advantage of using corrugated sheet material is that the corrugations provide the ability to use more material, without significantly increasing the overall size or bulk of the boom section, or having to add additional structural components, such as welding thicker or larger pieces therein. As an example, if a boom section having, for instance, a diameter of 6 feet (1.8 m) were to be built of a non-corrugated sheet material, a 18.9 foot (5.7 m) section of sheet material, (i.e. the length from one lateral edge to the other lateral edge), would be formed or rolled into the boom section. If, however, the sheet material were corrugated, and at least 1.5 times the material were used because of the corrugations, then the resulting boom section would be made from a non-corrugated sheet having a length of 28.4 feet (8.5 m), which is then corrugated. Although more material was used, the size of the boom section is not dramatically increased, but the structural integrity is. Preferably, the sheet material having corrugations would be used at least in a critical stress area of the boom section, thereby providing additional strength in that area(s), as shown, for instance, in FIG. 6. Although FIG. 6 shows lateral sides formed from a curved sheet material, it will be understood that the sides could also be straight. The term "critical stress area" as used herein is that area of the boom section subject to the greatest stress loads as would be understood and easily calculated by those having ordinary skill in the art. It should also be understood that the boom sections of the present invention are not only practical for use in cantilevered booms, but also for use in booms subjected to axial compressive forces.

Figure 3:
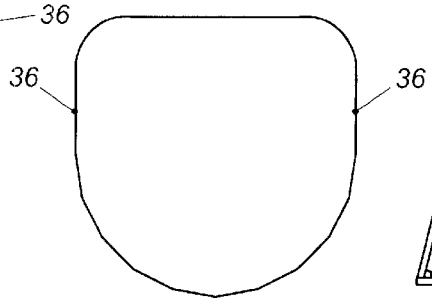
Figure 4:
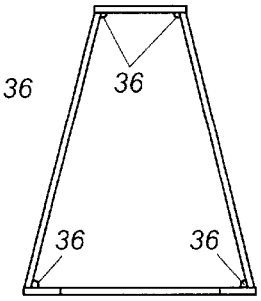
Figure 5:
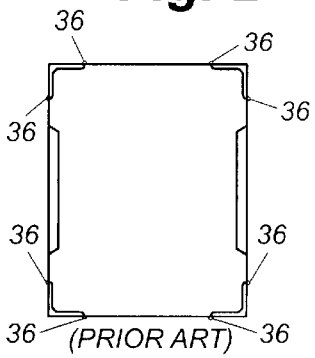

Boom sections shown in FIGS. 4 and 5, (boom sections of the prior art), use various steel materials welded together lengthwise in order to increase stiffness and prevent buckling. FIG. 5 is an embossed boom section wherein the internal protrusion on the side walls constitutes a hexagonally-shaped embossment pressed into the side wall. Further, the boom section shown in FIG. 5 includes relatively thick pieces of angle iron welded into the joints. To manufacture these boom sections a multiplicity of full-length welds 36, in relatively heavy gauge material are required, making them relatively expensive booms to build. The boom section shown in FIG. 3 is formed from at least two thick, flat (or non-corrugated) sheets of plates and is designed to require two full-length welds 36 to complete formation of the boom section. The crease pattern used is designed to eliminate wide flat areas where the boom is loaded in compression. The allowable width of flat areas without support is limited by a prescribed maximum width-to-thickness ratio in order to prevent local buckling. The boom section in FIG. 3 exhibits the shortest flat area between creases, but the creases are not very pronounced. Application of the present invention to the boom section shown in FIG. 3 would be advantageous in that the boom sections could be made thinner, lighter and more rigid.

Additionally, the boom sections of the present invention are shaped or formed into a columnar shape. By "columnar" what is meant is that the boom sections have the ability to support a compressive load upon the longitudinal axis and that the sections generally take the shape or form of a column. Again with reference to FIGS. 6 to 13, typical cross-sectional views are provided of exemplary boom sections of the present invention. Each of these cross-sectional views, (of course including the fact that each boom section has a length as shown in the other figures), is included in the definition of columnar as used herein. In other words, the cross section useful in the present invention includes circular, semi-circular, square and rectangular cross sections. The only caveat with respect to the shape is that the boom section, once formed into a column, must be able to support the required load and sustain any compressive, bending and/or torsional forces exerted upon it. In one embodiment of the present invention, the boom sections will have at least a semi-circular cross section.

Figure 23:
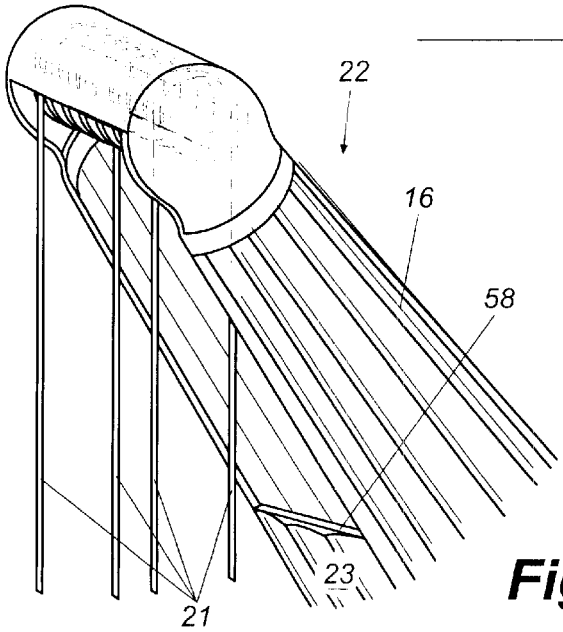
FIG. 23 is a partial perspective view of the tip boom section according to one embodiment of the present invention.

FIG. 23 is a perspective view of a typical tip boom section 16 according to the present invention. In this view, it can be seen that a bottom side 23 of the tip end 22 of the tip boom section 16 is partially cut away to accommodate the plurality of cables or ropes 21 typically extending from the tip of a crane. It may be appropriate, in such a configuration, to attach a support bracket such as that shown at 58 to provide structural integrity to the tip boom section 16. Further, it is possible that the tip end 22 of the tip boom section may take the form of a square, oval or rectangle. Whatever the shape, it is necessary that at least a portion of the tip end 22 maintain positional relationship with the adjacent boom section during extension or retraction.

Of course, as would be understood by one of ordinary skill in the art, it is possible to form the individual boom sections in varying lengths and diameters, depending upon the load capacity and the reach of the boom needed. Likewise, it is possible to create the extending boom from a single base boom section and a single tip section. It is possible to include at least one intermediate boom section or even a plurality of boom sections. Of course, it will be understood by one of ordinary skill in the art that the total length of the extending boom can be configured to have as many intermediate sections as necessary to achieve the maximum length required to suit the needs of a particular job.

Individual boom sections may have diameters of about 1 to 12 feet (0.3 to 3.6 m) and lengths of about 5 to 80 feet (1.5 to 24 m). It is not necessary that each of the boom sections have the same length. The overall fully extended length of the extending boom can be from about 20 to 600 feet (6 to 180 m). As shown in FIG. 24, the sections are roughly 6 feet (1.8 m) in diameter, 30 feet (9 m) in length, and the overall extended length (having 6 sections of the same approximate length) is about 185 feet (55.5 m).

Each of the boom sections may be manually or automatically extended and/or retracted. If automatic extension is required, a mechanism for telescopically advancing (i.e. to extend and/or retract, not shown) each of the boom sections may include the use of at least one hydraulic ram, multiple rams, chains or wire ropes reeved through blocks attached to the boom sections, and the like. The mechanism for telescopically advancing the boom sections may be situated internally or externally within the base boom section 12 (not shown). U.S. Pat. No. 4,156,331 to Lester et al. illustrates a boom using two rams. U.S. Pat. No. 5,678,708 to Forsberg et al. illustrates a boom using multiple rams. U.S. Pat. No. 4,133,411 to Curb and U.S. Pat. No. 4,327,522 to Sterner illustrate a boom operated by a single ram or hydraulic cylinder. Each of these patents is incorporated herein by reference in its entirety.

Of course, there are numerous ways to extend and/or retract the boom sections as one of ordinary skill in the art would understand. It is also contemplated herein that, in the case of multiple rams, it is possible to operate the rams as follows: while one ram is extending a new boom section, the other ram is retracting to grasp and telescopically extend the next boom section. Conventional controls (not fully shown) may be provided to enable an operator to selectively operate the mechanism for telescopically advancing the boom sections.

Further, the mechanism for telescopically advancing the boom sections will preferably occur in a successive fashion. In other words, if the tip boom section is the first boom section to be extended, the adjacent boom section will not begin to extend until the tip boom section is in a fully extended position. As provided for and described in greater detail below, a locking mechanism is provided on the boom sections to secure adjacent boom sections to each other when the former boom section reaches its fully extended position. Preferably, a locking mechanism actuator (not shown) will be situated on the base boom section. Alternatively, a remote locking mechanism actuator may be used.

Figure 15A:
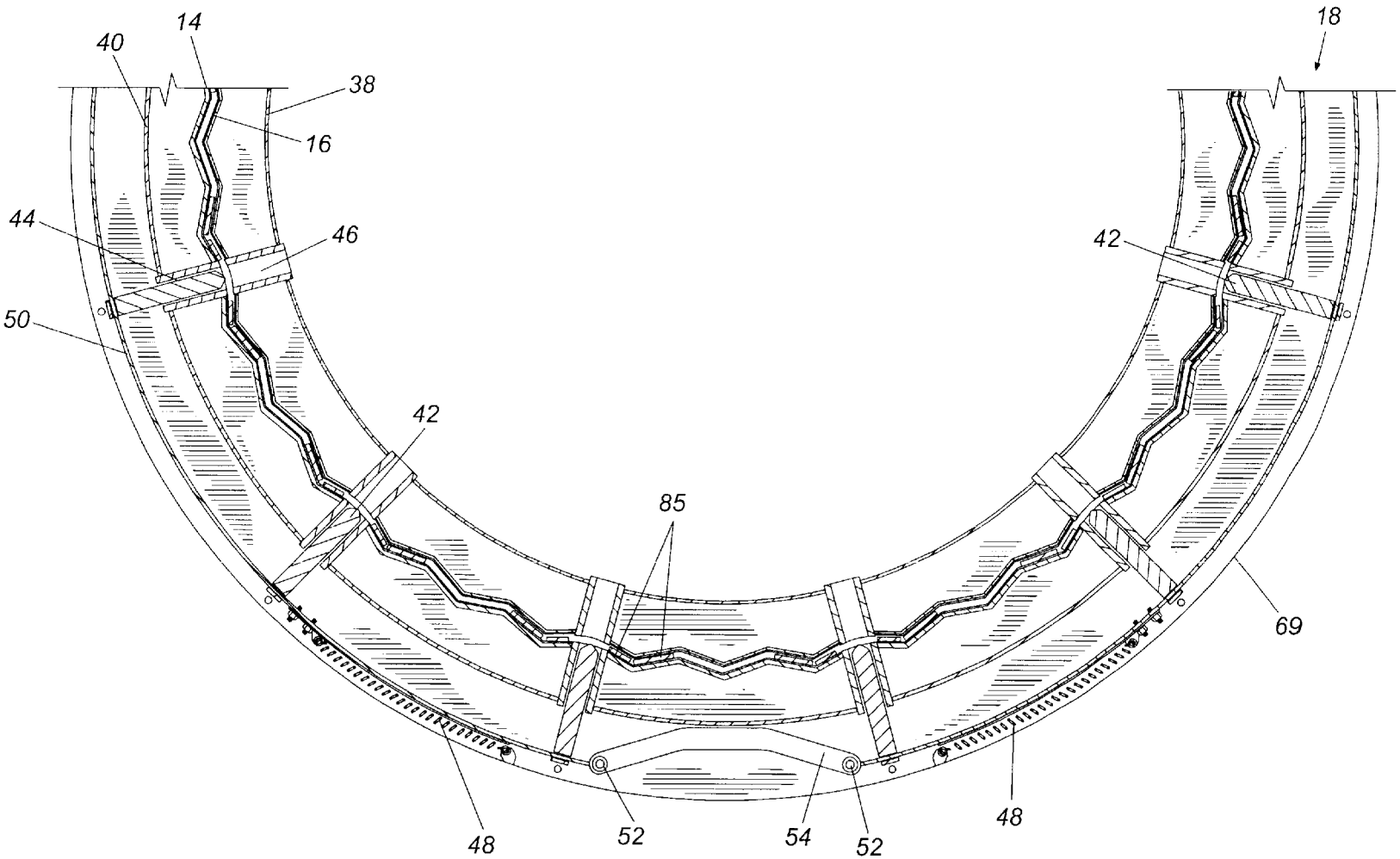
FIGS. 15*a* and 15*b* are exploded partial cross-sectional bottom views of the releasable locking mechanism according to the embodiment of FIG. 16.
Figure 15B:
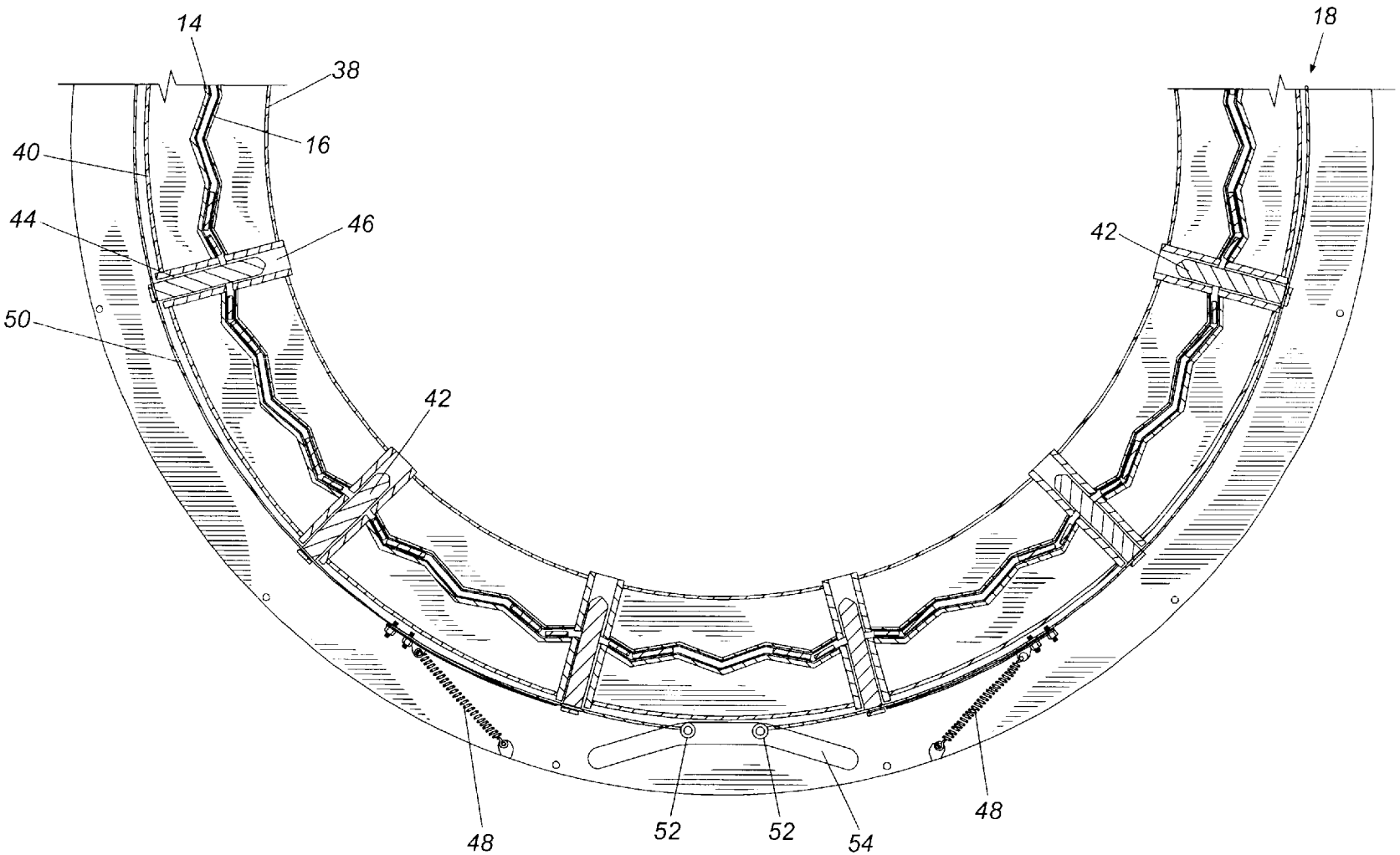
Figure 16:
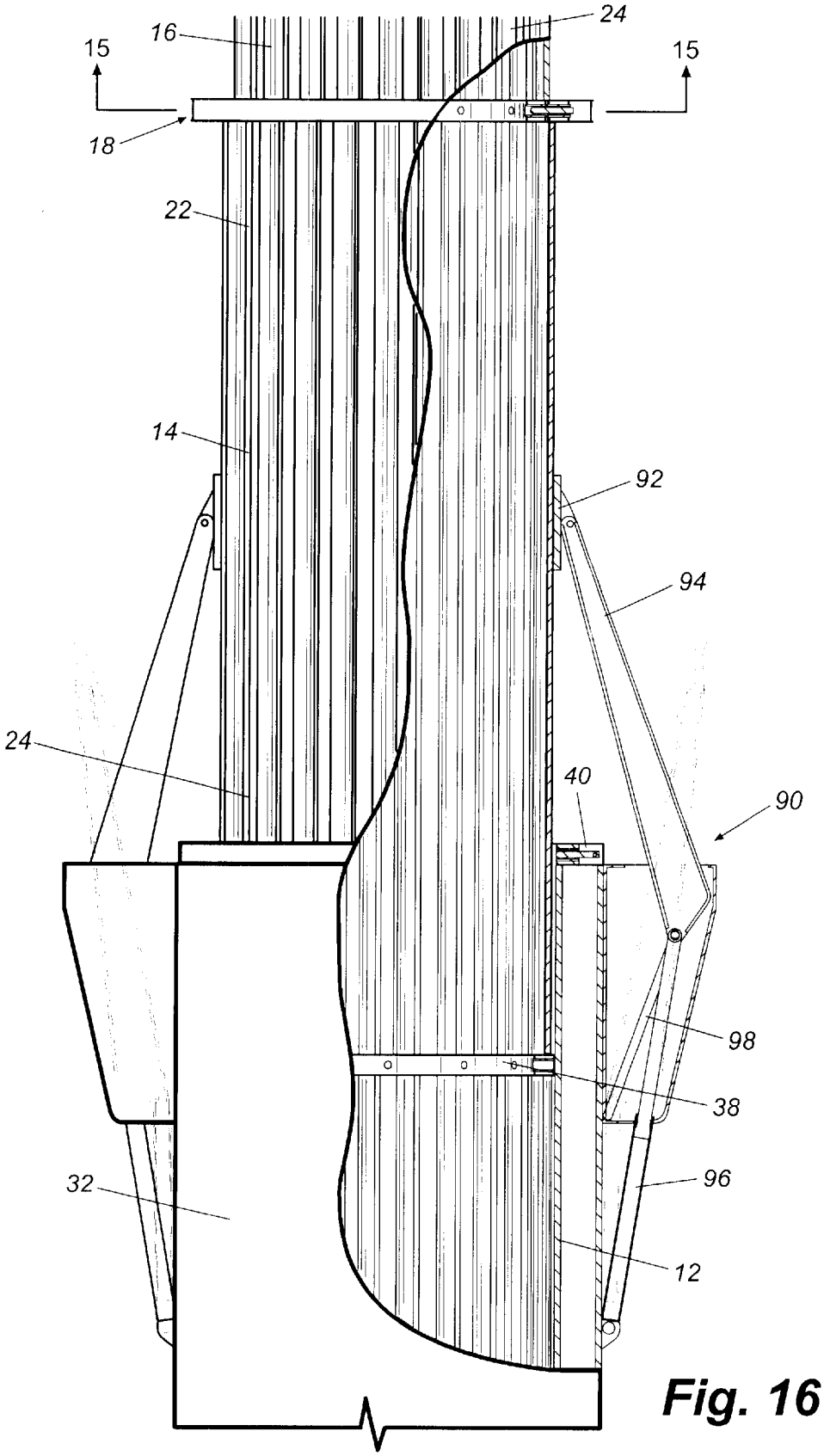
FIG. 16 is a partially cut-away side view of the operation of the mechanism for providing stability and support according to one embodiment of the present invention.

More specifically and with reference to FIGS. 15*a* and 15*b*, (which is an exploded partial cross-sectional bottom view taken along the lines 15—15 of FIG. 16), the releasable locking mechanism 18 is arranged to secure each of the boom sections in a way that maintains positional relationship of the boom sections when each individual boom section is in a fully extended position. The locking mechanism 18 according to one embodiment of the present invention allows the boom section to fully extend since the mechanism has two components: one attached at or near the base of one boom section and the other attached at or near the tip of the adjacent boom section. In other words, overlapping the boom sections is not necessary since the locking mechanism is thus situated.

Turning to FIG. 16, the releasable locking mechanism 18 may be attached to or near the tip or forward end 22 of a boom section, such that it is releasably lockable to the base or rear end 24 of the adjacent boom section when that boom section is in its fully extended position.

The releasable locking mechanism 18 is shown in an exploded partial cross-sectional bottom view in FIGS. 15*a* and 15*b*. With reference to these figures and, for instance, FIG. 16, a forward collar 40 is attached to the distal edge of the tip end 22 of an intermediate boom section 14, and is covered by a casing 69. (The casing 69 is essentially an access cover which is removable for maintenance.) A plurality of pins 42 are received within respective cavities 44 in the forward collar 40. Likewise, the base end 24 of the adjacent intermediate boom section 14 has a rearward collar 38 attached to the distal edge of the base end. (Although the collars 38 and 40 are shown herein as hollow collars, (with a hollow cylinder forming the cavities 44 and 46), it will be understood that the collars may also be formed of solid materials, as long as the overall weight of the boom is not adversely impacted.) In the locking arrangement, the forward collar 40 and the rearward collar 38 are juxtaposed, that is, situated side-by-side. The rearward collar 38 has corresponding cavities 46 for receiving the pins 42. (The rearward collar 38 may additionally include a lip or projecting edge (not shown) extending from the lower edge of the collar to "catch" the rearward collar on the forward collar and thereby keep the boom section from overextending, e.g. slipping out of the adjacent boom section.) The pins 42 are movable within the cavity 44, typically using a spring device(s) 48 in conjunction with a snap ring 50 and a lug(s) 52 moveable within a guide slot 54. (As used herein, the term "lug" means an earlike projection for the attachment of another part to it and includes slidable elements such as a slidable bolt, slidable rod, and the like. The lug may also be hollow so as to receive a device adapted to position the lug within the guide slot.)

Figure 28A:
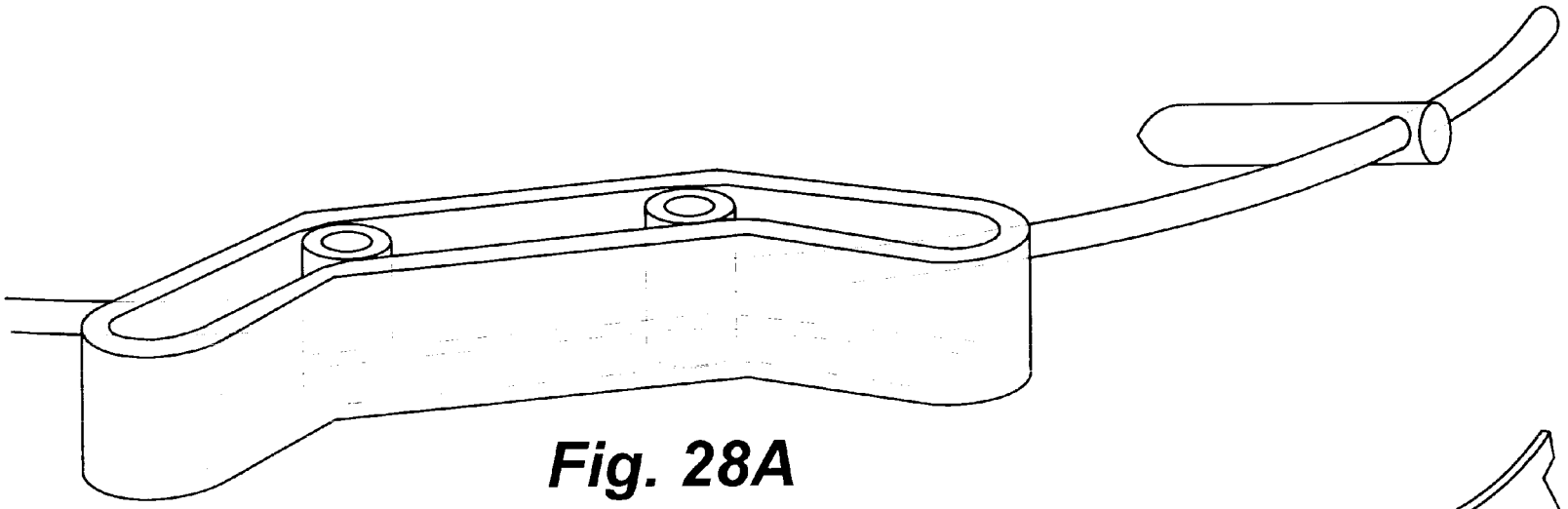
FIGS. 28*a* and 28*b* are exploded perspective views of a snap ring configuration according to one embodiment of the present invention.
Figure 28B:
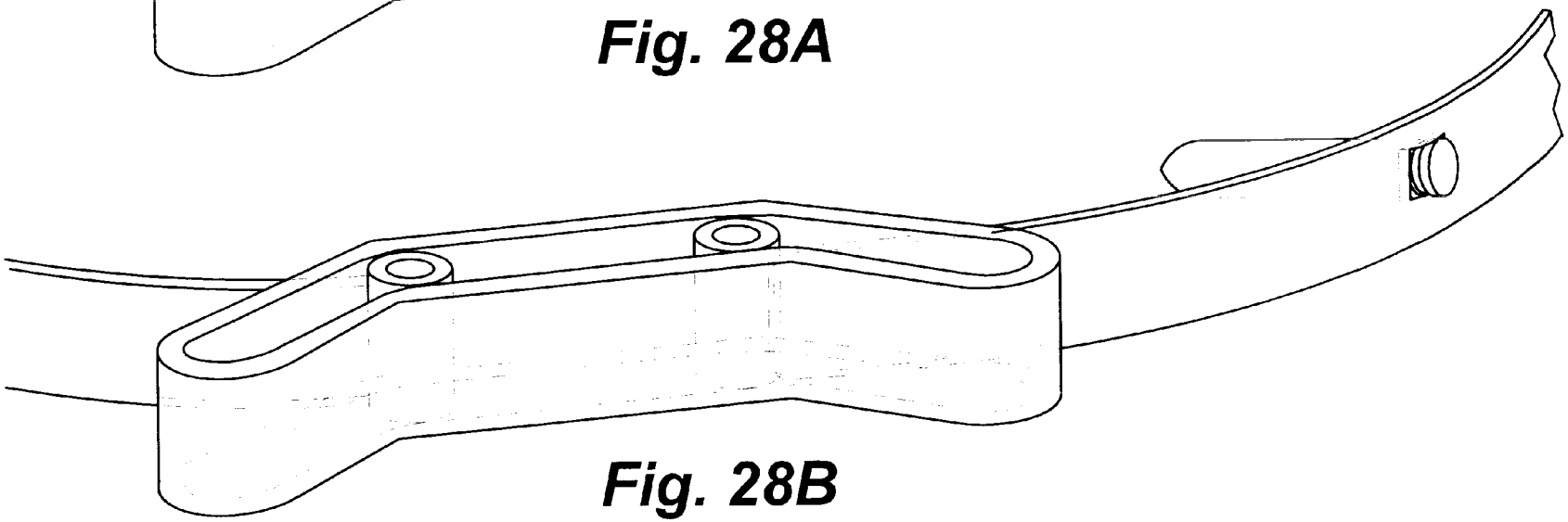

The snap ring 50 is slidably coupled to each pin 42 by mechanisms known by those of ordinary skill in the art and as for instance can be seen in the various figures. It is possible to configure the pin 42 to be slidable around the snap ring 50 if, for instance, the snap ring is formed by a tubular member such as that shown in FIG. 28*a*. Such configurations may include, but are not limited to, the following slidable attachments: a hole drilled through the end of each pin 42, an eye-bolt set in the end of the pin 42, a plate bolted over a channel cut in the end of each pin 42. It is possible to configure the snap ring having a notched or slotted area in the snap ring 50 and slidably coupling the pins 42 within the notched areas as can be see, for instance in FIG. 28*b*.

Although twelve pins are shown in the figures, it will be understood by one of ordinary skill in the art that less than twelve pins may be used, depending on the load capacity of the crane. In fact, it is believed that at least 3 pins are necessary to perform the locking and alignment function. The snap ring 50 is also coupled to the spring devices 48 and the springs are extended as, for instance, shown in FIG. 15*a*. The ends of the snap ring 50 are attached to the lugs 52. Prior to activation of the releasable locking mechanism 18, the lugs 52 are positioned at the outer edges of the guide slot 54. Upon activation, the lugs 52 move towards each other to the center of the guide slot 54, aided by the spring devices 48. (It should be noted that although the springs are not as extended as the position of FIG. 15*a*, the springs remain under tension when the mechanism is in the locked position.) Thus, the diameter of the snap ring 50 decreases, pushing the pins 42 into the corresponding cavities 46. In other words, when the intermediate boom section 14 is fully extended, the pins 42 are actuated and hence respectively received in the corresponding cavity 46 in the rearward collar 38, thereby locking the adjacent boom sections together while maintaining substantial alignment along a longitudinal axis of the extending boom 20. FIG. 15*b* shows the releasable locking mechanism 18 in its actuated position wherein pins 42 are slidably engaged in rearward collar 38, effectively locking intermediate boom section 14 to another intermediate boom section 14 and securing the boom sections three dimensionally—including laterally and vertically. To say that the locking mechanism is actuated means that a device or locking mechanism actuator, adapted to position the lug within the guide slot, is capable of opening and or closing the snap ring so as to move the pins into or out of the rearward collar. Devices for actuating the locking mechanism are known to those of ordinary skill in the art and thus are not shown herein.

Currently available telescoping cranes use one or two pins to engage and retain each boom section from retracting. The boom sections are held in alignment, so that the boom is relatively straight, by overlapping about 20% of the length of each extensible boom section nested within its adjacent section. The present invention obviates the practice of wasting 20% of the available boom length as dead weight left retracted within the adjacent boom section. In fact, the present invention furnishes a possibility for utilizing nearly all of the available boom length.

The releasable locking mechanism according to one embodiment of the present invention not only keeps the individual boom sections from retracting within the adjacent boom section, but also locks the two boom sections in horizontal and vertical alignment. The 20% unused boom length overlap of existing cranes currently available is no longer necessary. Of the many advantages: decreased overall weight, decreased manufacturing costs, and a more rigid extended boom having less loose motion between the individual boom sections, figure prominently.

In order to more fully extend (i.e. without the need to overlap the boom sections) one boom section from within the other it is advantageous to furnish support to the boom section being extended until the releasable locking mechanism is engaged. FIG. 16 also shows a partially cut-away side view of the operation of a mechanism for providing stability and support including stabilizing arms 90, which may be utilized to at least partially support and/or stabilize the boom sections as extension (or retraction) occurs. The stabilizing arms are particularly useful in the present invention wherein the boom sections are nearly fully extended and have limited overlapping of the boom sections. The stabilizing arms assist in stabilization of the extending boom section until the releasable locking mechanism is activated. As shown herein, each stabilizing arm 90 may include a shoe 92, an angled member 94 and a hydraulic cylinder 96. In the section engaging position, the shoe 92 maintains positional relationship of the boom section during extension (or retraction) from a nesting position within the adjacent boom section, by acting in unison with other stabilizing arms by exerting enough force against the boom section to maintain the positional relationship of the boom section without adversely impacting the extension (or retraction) of the boom section. Although the use of four arms is suggested in the various figures, it will be understood that two, three or more arms may be used to stabilize the boom section.

The shoe 92 is typically pivotally attached to the forward end of the angled member 94. At the rear end of the angled member is mounted a hydraulic cylinder 96. The hydraulic cylinder 96 maintains pressure when the shoe 92 is needed to stabilize the boom section, but may be retracted to disengage the shoe 92 when necessary as shown in the dotted lines of FIG. 16. As shown herein, the angled member 94 is slidable within a rabbet 98, (such as a channel, groove or recess which may be formed into the structural frame 32), to position the stabilizing arm 90 into or out of contact with the boom section.

In operation and as a boom section is extended, the stabilizing arms are positioned as follows to support the boom section. The hydraulic cylinder 96 urges the angled member 94 from the retracted position at the lower end of the rabbet 98 to the upper end of the rabbet. Because of the shape of the angled member 94, the shoe(s) 92 then engages or otherwise provides supportive and stabilizing force to the boom section. The stabilizing arms 90 allow firm contact of all the different sizes of nested boom sections. It is further contemplated herein that control of the movement of the stabilizing arms 90 may be accomplished using limit switches (not shown) so that the arms work in synchronization with the extension or retraction of the multiple boom sections.

In typical operation, the tip boom section 16 is first extended by mechanisms previously described herein until the individual boom section reaches its fully extended position. At this point, the releasable locking mechanism 18 is actuated, either manually or automatically, thereby locking the tip boom section 16 to the first intermediate boom section 14. It is possible to stabilize the extending boom section using the stabilizing arms 90, or the mechanism for advancing the boom sections as described above, or any combination thereof. Once locked into position, it is no longer necessary to support that boom section. In other words, retraction or collapse of the boom section will not occur when the stabilization is no longer provided. The intermediate boom section 14 is then likewise extended and subsequently locked. This continues until all of the intermediate boom sections 14 are fully extended and locked, and then intermediate boom section 14 adjacent the base boom section 12 locks into place.

Figure 20:
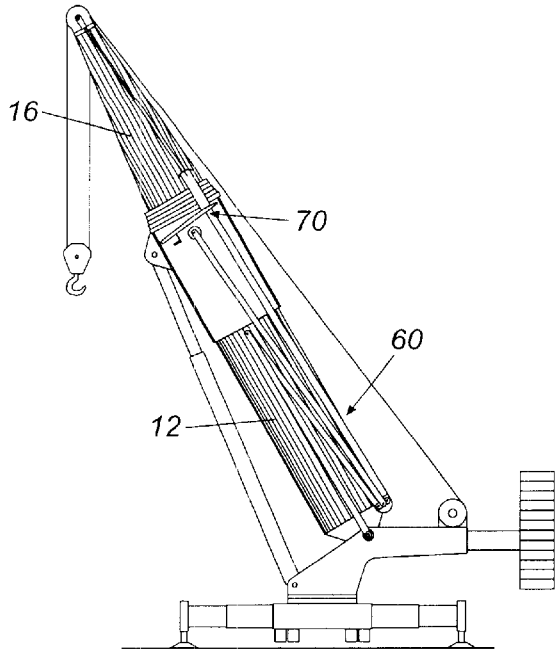
FIGS. 20–22 are side views of the telescoping boom crane according to one embodiment of the present invention, shown in three stages of extension.
Figure 21:
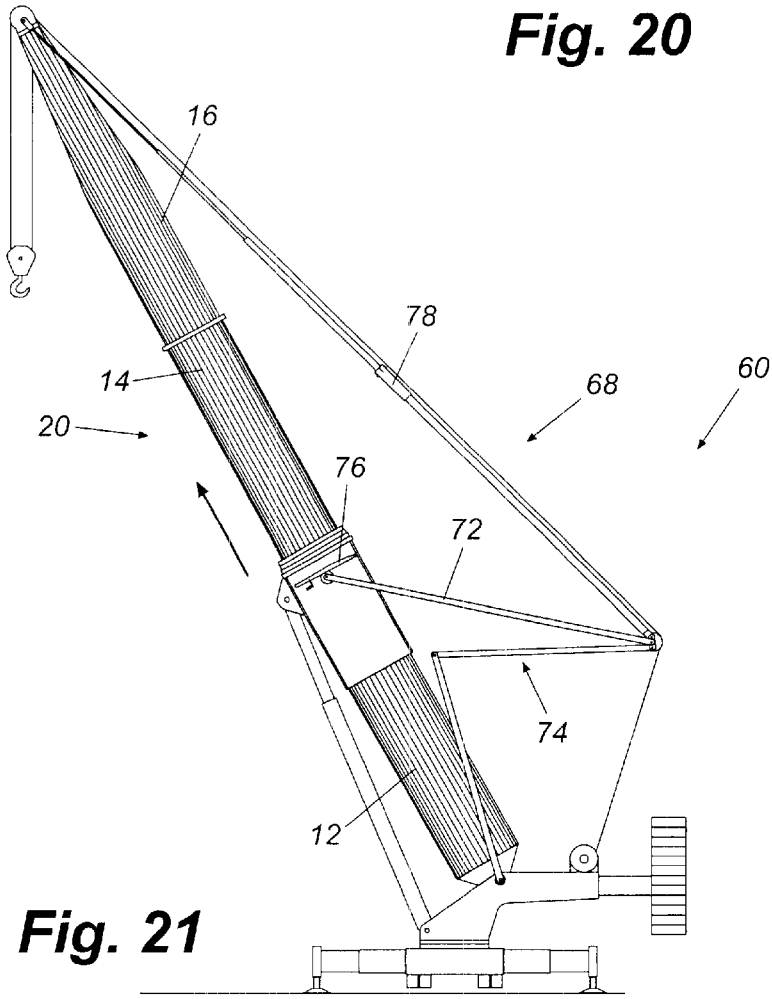
Figure 22:
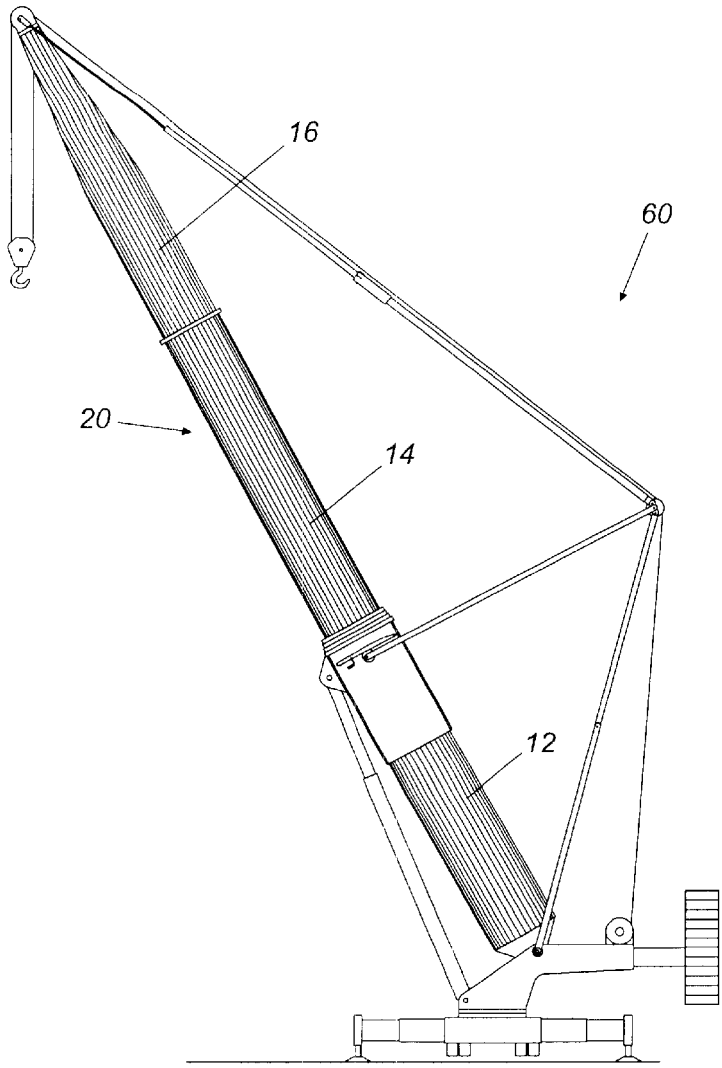

Because the individual boom sections are individually secured before the adjacent boom section is advanced, it is possible to operate the telescoping boom crane in a partially extended configuration as shown in FIGS. 20–22. FIGS. 20–22 additionally show the successive fashion of extending the boom a section at a time. In FIG. 20, tip boom section 16 and the intermediate boom sections 14 are nested within the base boom section 12. Further, the extensible pendant support system 60 is positioned in its stowed position. As the tip boom section 16 and the first intermediate boom section 14 extend, the pendants are likewise extended until locked at the proper length, (i.e. to coincide with a partial extension of the telescopically extending boom 20). In FIG. 21, the forestay 68 is locked and the mast 72 and backstay 74 are being pulled into their supporting position. FIG. 22 shows the partially extended boom with the extensible pendant support system 60 in the working position to at least partially support the extended boom. In this way, it is possible to utilize the extending boom 20 of the present invention in a configuration of less than the full extensibility of the boom. In this case, once the required length is achieved, the remaining boom sections will not be extended, but instead will remain in the fully retracted position. It is not contemplated herein, however, that the boom sections may be partially extended. Instead, each of the boom sections that is extended, must be extended to its full extensibility and hence locked into that position.

As each of the boom sections extends, so too does a telescoping pendant. This invention additionally furnishes an extensible pendant support system 60 for the telescoping crane 10 which does not hinder mobility or set-up convenience and is erectable by the operator from the control station as needed. With reference to the various figures, particularly FIG. 1, the present invention includes nesting, telescoping pendants designed to provide at least partial support for the telescopically extending boom 20 when the boom is in an extended position. Although most of the figures are drawn showing a two-dimensional side view of the telescoping crane according to one embodiment of the present invention, FIG. 1 shows a perspective view, wherein it is seen that, when necessary, the extensible pendant support system 60 according to one embodiment of the present invention includes two such systems.

Figure 26A:
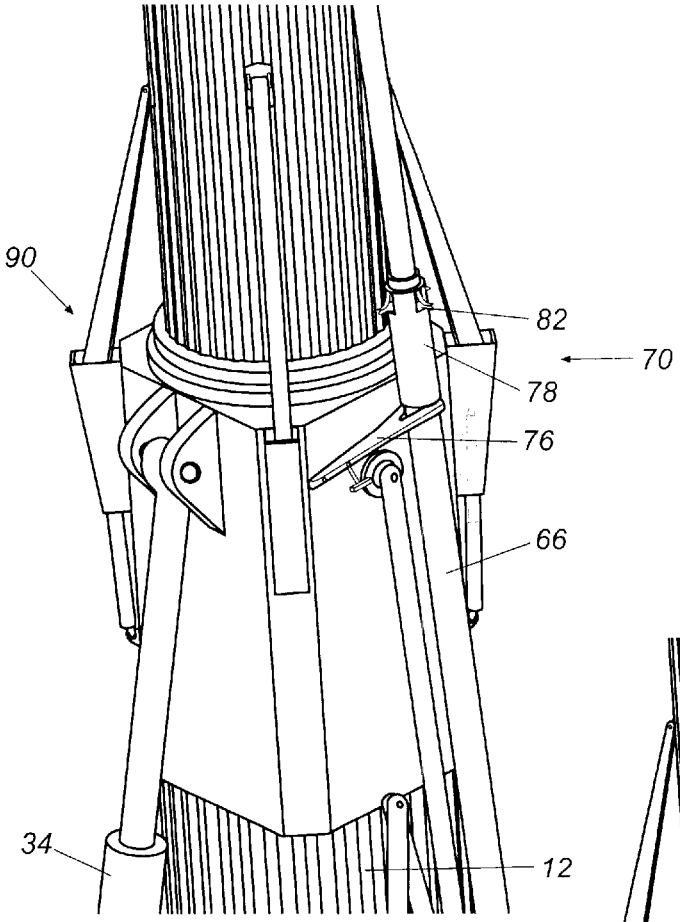
FIGS. 26*a* and 26*b* are partial perspective views of the support arms according to one embodiment of the present invention.
Figure 26B:
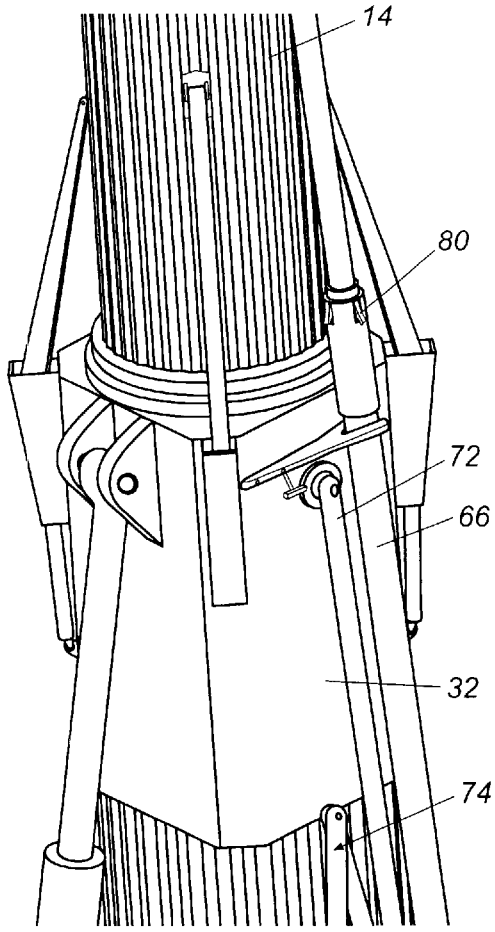

Typically, the extensible pendant support system 60 includes at least one forestay 68, (otherwise known as a mainstay) made of a plurality of pendants, at least one backstay 74, at least one mast 72 and a forestay length locking device 70 (best seen in FIGS. 26*a* and 26*b*).

Figure 14A:
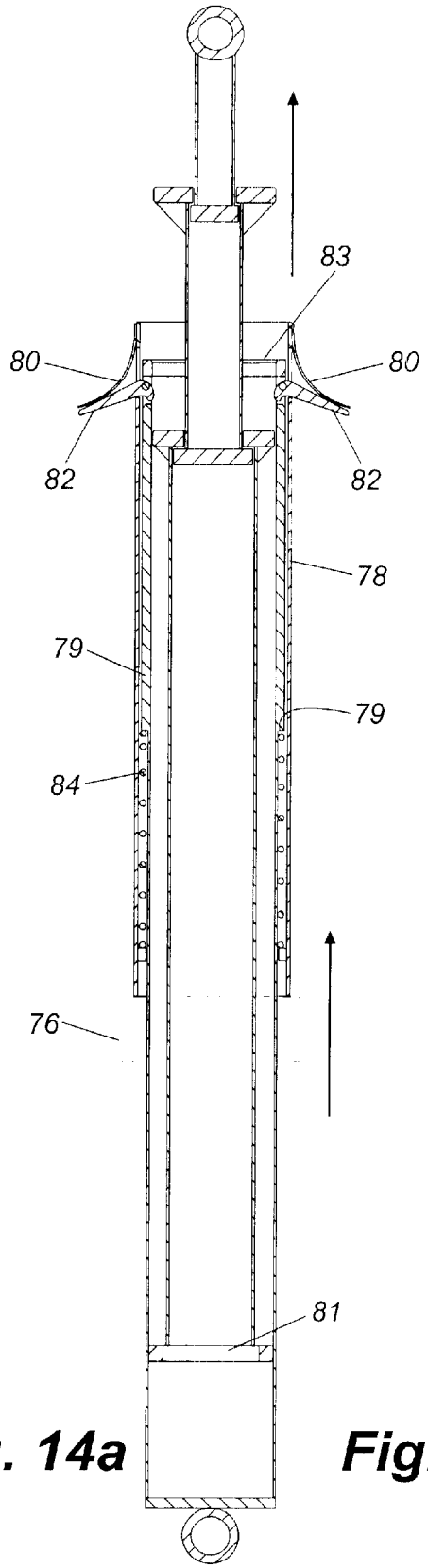
FIGS. 14*a* and 14*b* are cross-sectional side views of the pendant support system, including the forestay length locking device according to one embodiment of the present invention.
Figure 14B:
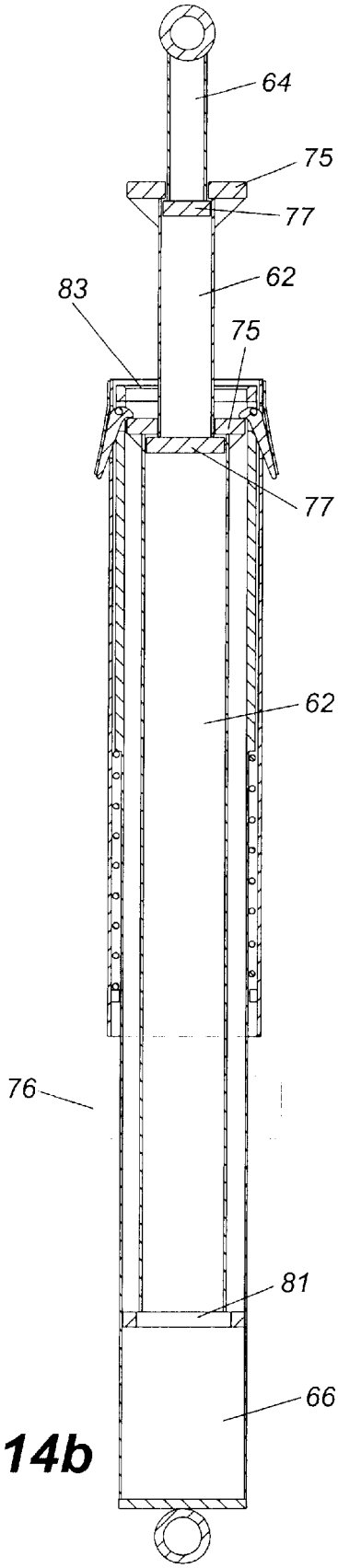

The system 60 includes a plurality of pendants including at least a tip pendant 64 and a base pendant 66, as can be seen more clearly in FIGS. 14*a* and 14*b*. The extensible pendant support system 60 may further include at least one intermediate pendant 62 situated between the base pendant 66 and the tip pendant 64. Similar to the boom sections, each of the pendants will have a successively smaller cross section to allow each of the pendants to be extensibly receivable within the adjacent pendant. The pendants will typically have a tubular or cylindrical shape. As shown in the figures, the pendants can have different lengths, or alternatively can have equal lengths. Also, although the pendants as shown herein appear cylindrical in shape, it will be understood that the pendants may take other geometrical forms, as long as nesting and extension could be accomplished. Exemplary of such forms include cross-sections that are rectangular, octagonal, hexagonal, square, oval, Z-shaped, C-shaped, and the like.

Figure 27:
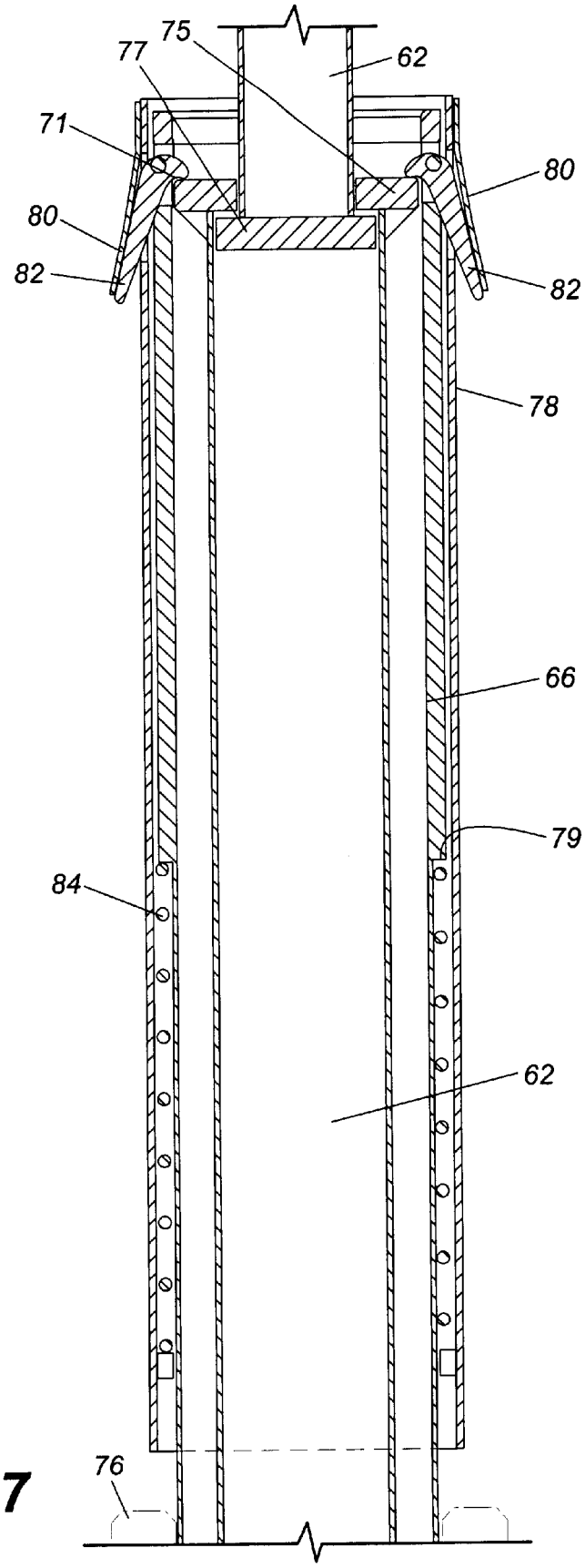
FIG. 27 is a partial exploded cross-sectional side view of the pendant support system according to the embodiment of FIG. 14*b*.

With reference to FIGS. 14*a*, 14*b* and 27, a cross-sectional side view of the plurality of pendants is provided. In FIG. 14*b*, the tip pendant 64 is shown in an extended position and extensibly receivable within intermediate pendant 62. The first intermediate pendant 62 extends from another intermediate pendant 62, which is nested within base pendant 66. Each of the intermediate pendants 62 will have a forward flange 75 and a rearward flange 77. In the final intermediate pendant, a final rearward flange 81 will keep the pendants from overextending out of the base pendant 66. One embodiment includes the use of a fitting 83 at the distal tip end of the base pendant 66 which is sized sufficient to allow passage of the forward flanges 75, but will not allow the final rearward flange 81 to pass through. The tip pendant 64 also has a rearward flange 77. The flanges serve the functions of maintaining the pendants nested within the adjacent pendant and to prevent further extension of any given pendant as will be discussed in more detail below.

A sleeve 78 is attached to an external surface of the base pendant 66. At least one hinged detent 82 is pivotally attached to the base pendant 66 and extends through a corresponding aperture in the sleeve 78 as shown in the figures. In operation and during extension of the pendants, an extending arm 76 is activated to apply pressure against the rearward end of the sleeve 78. A spring 84, situated between the sleeve 78 and a protruding edge 79 of the base pendant 66, is compressed as extending arm 76 pushes the sleeve up against the lower surface of the hinged detent(s)

82. A leaf spring 80 acts upon the upper surface of the hinged detent 82 to urge is back towards a latched position. When in an extending position, the pendants are allowed to pass by the ledge or catch 71 of the hinged detent 82. When locking the pendants against further extension, the extending arm 76 is deactivated, thereby releasing the sleeve 78, which is pushed rearward by spring 84. The hinged detent(s) 82 return to a closed position urged by leaf springs 80, thereby preventing further pendants from extending since the ledge (s) 71 catches upon the upper surface of the forward flange 75 of the pendant.

Each of the pendants is extensibly receivable within an adjacent pendant and the tip pendant 64 is attached, for instance, to the tip end 22 of the tip boom section 16. Alternatively, the tip pendant may be attached to any one of the intermediate boom sections. Typically, the tip pendant 64 is pivotally attached to the boom section. Likewise, the base pendant 66 may simply be attached to the base boom section 12 (not shown, by for instance, attachment to a short rigid structure extending from the base section or support structure), or alternatively, attached to the mast 72.

As shown in the various figures, the forestay 68 is a length-lockable telescoping pendant forestay made of the telescoping pendants. The forestay length locking device 70 will be discussed in more detail below.

Figure 25:
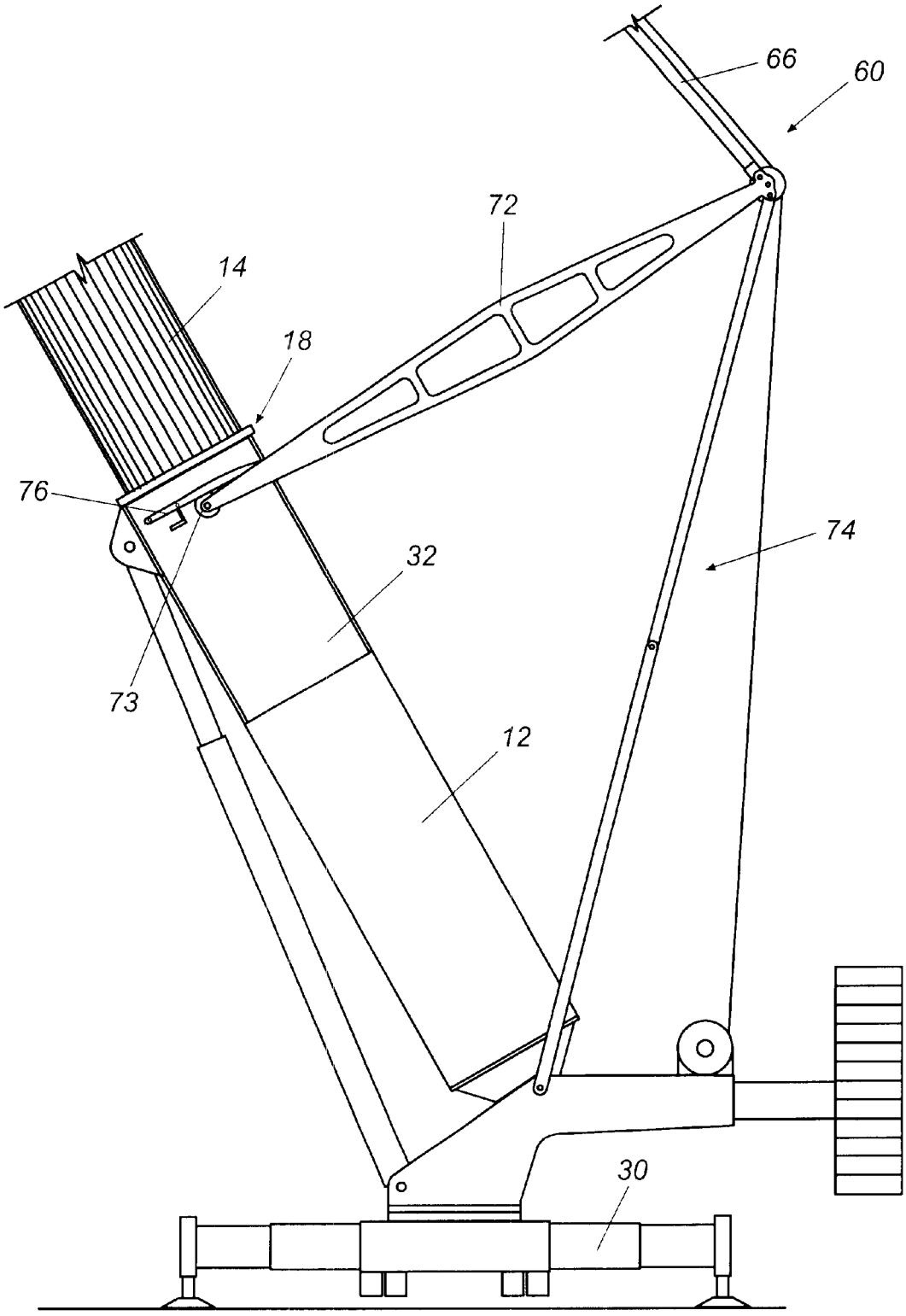
FIG. 25 is a side view of an alternative mast according to another embodiment of the present invention.

In one embodiment of the present invention, the mast 72 is pivotally connected to the base boom section 12 (not shown), or alternatively, to the structural frame 32. As shown herein, the base pendant 66 is attached to the mast 72. The mast 72, as shown here, is capable of pivoting around pivot point 73 and thus stored in a stowed position prior to extension of the extending boom 20. Further, the mast 72 may be configured as a geometrically complex beam, as shown in FIG. 25, or may have a simpler geometry, such as a cylinder, tube, channel, I-beam, C-channel, or the like, as necessary based on the anticipated load requirements. The backstay 74 is typically pivotally connected on one end to the structural frame 30 or the base boom section 12 (not shown) and pivotally connected at the other end to the mast 72. As shown herein, the backstay 74 includes two members engaged so as to conveniently fold into a stowed position, but is easily drawn out to its extended position when the forestay 68 is locked and the boom extended further.

As can be seen in FIG. 20, the pendant support system 60 is shown in a stowed arrangement. The boom sections can be extended or retracted without hindrance from the pendant support system. In operation, as the boom sections extend, the pendants will advance telescopically from the base pendant 66. As the extending boom extends, it causes extension of the extensible pendant support system. Once extended to the working length, the extensible pendant support system at least partially supports the extending boom when a load is applied to the extending boom. As described above, partial extension of the extending boom, would cause a similar partial extension of the extensible pendant support system such that the ability to support a load from the extending boom is maintained.

Turning again to FIG. 21, a partially extended configuration is shown wherein the forestay 68 was locked at the length shown just prior to extending the intermediate boom section 14 from its retracted position within base boom section 12. As the multi-sectioned, telescopically extending boom 20 advances, the forestay 68 likewise advances, raising the mast 72 from the folded back stowed position, and unfolding and tensioning the backstay 74. The mast 72 will be pivoted into a position substantially perpendicular to the extended boom 20 since the backstay 74 will be pivoted into its straightened position and stops the mast 72 at the perpendicular position.

Similar to the boom sections, the pendants have a forestay length locking device 70 for prohibiting extension of a subsequent pendant from the adjacent pendant once the former pendant achieves an extended position, as seen, for instance, in FIGS. 14 and 26.

The telescoping boom crane according to one embodiment of the present invention includes several features which combine and cooperate to make an extremely efficient telescoping boom which can be made much longer, lighter and more rigid than currently available telescoping booms.

The terms and expressions which have been employed herein are used as terms of description and not of limitation, and there is not intention, in the use of such terms and expressions, of excluding any equivalents of the features shown and described or portions thereof. Having thus described the invention in detail, it should be apparent that various modifications can be made in the present invention without departing from the spirit and scope of the following claims.

I claim:

1. A telescoping boom crane comprising:

a) a multi-sectioned, telescopically extending boom further comprising;

a base boom section, and a tip boom section being extensibly receivable within the base boom section, the boom sections comprising a sheet material, wherein at least one of the boom sections comprises a sheet material having corrugations extending along a length of the sheet material, the boom sections being columnar in shape, and the tip boom section having a smaller cross section than the base boom section to allow the tip boom section to be extensibly receivable within the base boom section; and b) an extensible pendant support system further comprising;

a plurality of pendants comprising at least a tip pendant and a base pendant; each of the pendants being extensibly receivable within an adjacent pendant, the tip pendant being attached to the tip boom section, and the base pendant being attached to the base boom section;

wherein extension of the extending boom causes extension of the extensible pendant support system and wherein upon applying a load to the extending boom, the extensible pendant support system at least partially supports the extending boom.

2. The telescoping boom crane of claim 1, the extending boom further comprising at least one intermediate boom section situated between the base boom section and the tip boom section, wherein each of the boom sections has a successively smaller cross section to allow each of the boom sections to be extensibly receivable within the adjacent boom section.

3. The telescoping boom crane of claim 2 wherein the at least one intermediate boom section comprises a plurality of intermediate boom sections and the intermediate boom sections comprising a sheet material having corrugations extending along a length of the sheet material.

4. The telescoping boom crane of claim 3 wherein the boom sections are operative to accomplish a partial extension of the extending boom and the extensible pendant support system while maintaining an ability to support a load from the extending boom.

5. The telescoping boom crane of claim 3 wherein the tip pendant is pivotally attached to the tip boom section or any one of the intermediate boom sections.

6. The telescoping boom crane of claim 3 further comprising means for telescopically advancing in a successive fashion each of the boom sections.

7. The telescoping boom crane of claim 6, wherein the means is operative to begin advancing of the boom sections with the tip boom section.

8. The telescoping boom crane of claim 2 wherein the boom sections are operative to accomplish a partial extension of the extending boom and the extensible pendant support system while maintaining an ability to support a load from the extending boom.

9. The telescoping boom crane of claim 1 wherein the sheet material comprises a material having sufficient strength and rigidity to endure application of the load.

10. The telescoping boom crane of claim 9 wherein the sheet material comprises metal, plastic, expanded metal, or composite material.

11. The telescoping boom crane of claim 1 wherein the sheet material comprises a perforated material.

12. The telescoping boom crane of claim 1, the corrugations of the sheet material being folds of parallel and alternating ridges and grooves.

13. The telescoping boom crane of claim 1 wherein the sheet material comprises a single sheet shaped into the boom sections.

14. The telescoping boom crane of claim 13 wherein a single weld forms a joint between opposing lateral edges of the sheet material to maintain the shape of the boom sections.

15. The telescoping boom crane of claim 1 wherein the sheet material forms corrugations such that at least 1.5 times the material is used in a critical stress area of the boom section than would be if a non-corrugated sheet were used.

16. The telescoping boom crane of claim 1, the boom sections having at least a semi-circular cross section.

17. The telescoping boom crane of claim 1, the extensible pendant support system further comprising at least one intermediate pendant situated between the base pendant and the tip pendant, wherein each of the pendants having a successively smaller cross section to allow each of the pendants to be extensibly receivable within the adjacent pendant.

18. A telescoping boom crane attached to a support structure, the crane comprising:

a) a multi-sectioned, telescopically extending boom further comprising;

a base boom section;

at least one intermediate boom section extensibly receivable within the base boom section; and a tip boom section being extensibly receivable within an adjacent intermediate boom section;

each of the boom sections being formed of a sheet material, the sheet material having corrugations extending along a length of the sheet material, the boom sections being columnar in shape, and having a successively smaller cross section to allow each of the boom sections to be extensibly receivable within the adjacent boom section;

b) an extensible pendant support system further comprising;

a plurality of pendants forming a forestay, the forestay comprising at least a tip pendant and a base pendant; each of the pendants being extensibly receivable within an adjacent pendant, a mast pivotally connected to the base boom section, and a backstay pivotally connected on one end to the support structure and pivotally connected at the other end to the mast, the tip pendant being attached to the tip boom section, and the base pendant being attached to the mast;

wherein extension of the extending boom causes extension of the extensible pendant support system and wherein upon applying a load to the extending boom, the extensible pendant support system at least partially supports the extending boom.

19. The telescoping boom crane of claim 18 wherein the boom sections are operative to accomplish a partial extension of the extending boom and the extensible pendant support system while maintaining an ability to support a load from the extending boom.

20. The telescoping boom crane of claim 18 further comprising means for telescopically advancing in a successive fashion each of the boom sections and the advancing of the boom sections begins with the tip boom section.

21. The telescoping boom crane of claim 18 wherein the at least one intermediate boom section comprises a plurality of intermediate boom sections.

22. The telescoping boom crane of claim 18 wherein the tip pendant is attached to any one of the intermediate boom sections.

23. The telescoping boom crane of claim 18, the boom sections having at least a semi-circular cross section.

24. A telescoping boom crane comprising:

a) a multi-sectioned, telescopically extending boom further comprising;

a base boom section;

at least one intermediate boom section extensibly receivable within the base boom section; and a tip boom section being extensibly receivable within an adjacent intermediate boom section; each of the boom sections being formed of a sheet material, the sheet material having corrugations extending along a length of the sheet material, the boom sections being columnar in shape, and having a successively smaller cross section to allow each of the boom sections to be extensibly receivable within the adjacent boom section;

b) an extensible pendant support system further comprising;

a plurality of pendants comprising at least a tip pendant and a base pendant; each of the pendants being extensibly receivable within an adjacent pendant, the tip pendant being attached to the tip boom section, and the base pendant being attached to the base boom section;

wherein extension of the extending boom causes extension of the extensible pendant support system and wherein upon applying a load to the extending boom, the extensible pendant support system at least partially supports the extending boom; and c) a releasable locking mechanism arranged to secure each of the boom sections to maintain positional relationship of the boom sections when each individual boom section is in a fully extended position.

25. The telescoping boom crane of claim 24 wherein the at least one intermediate boom section comprises a plurality of intermediate boom sections.

26. The telescoping boom crane of claim 24 wherein the boom sections are operative to accomplish a partial extension of the extending boom and the extensible pendant support system while maintaining an ability to support a load from the extending boom.

27. The telescoping boom crane of claim 24 further comprising means for telescopically advancing in a successive fashion each of the boom sections and the advancing of the boom sections begins with the tip boom section.

28. The telescoping boom crane of claim 24 wherein the tip pendant is attached to any one of the intermediate boom sections.

29. The telescoping boom crane of claim 24, the boom sections having at least a semi-circular cross section.

30. A telescoping boom crane comprising:

a) a multi-sectioned, telescopically extending boom further comprising;

a base boom section;

at least one intermediate boom section extensibly receivable within the base boom section; and a tip boom section being extensibly receivable within an adjacent intermediate boom section;

each of the boom sections being formed of a sheet material, the sheet material having corrugations extending along a length of the sheet material, the boom sections being columnar in shape, and having a successively smaller cross section to allow each of the boom sections to be extensibly receivable within the adjacent boom section;

b) an extensible pendant support system further comprising;

a plurality of pendants forming a forestay, the forestay comprising a tip pendant and a base pendant; each of the pendants being extensibly receivable within an adjacent pendant, a mast pivotally connected to the base boom section, and a backstay pivotally connected on one end to the base boom section and pivotally connected at the other end to the mast, the tip pendant being attached to the tip boom section, and the base pendant being attached to the mast;

c) a releasable locking mechanism arranged to secure each of the boom sections to maintain positional relationship of the boom sections when each individual boom section is in a fully extended position; and d) forestay length locking device for prohibiting extension of a subsequent pendant from the adjacent pendant once the former pendant achieves an extended position;

wherein extension of the extending boom causes extension of the extensible pendant support system and wherein upon applying a load to the extending boom, the extensible pendant support system at least partially supports the extending boom.

31. The telescoping boom crane of claim 30 further comprising means for telescopically advancing in a successive fashion each of the boom sections.

32. The telescoping boom crane of claim 30, wherein the means is operative to begin advancing of the boom sections with the tip boom section and the releasable locking mechanism locks each of the adjacent boom sections into positional relationship before the next boom section is advanced.

33. The telescoping boom crane of claim 30 wherein the at least one intermediate boom section comprises a plurality of intermediate boom sections.

34. The telescoping boom crane of claim 30 wherein the boom sections are operative to accomplish a partial extension of the extending boom and the extensible pendant support system while maintaining an ability to support a load from the extending boom.

35. The telescoping boom crane of claim 30, the boom sections having at least a semi-circular cross section.

36. The telescoping boom crane of claim 30 wherein the tip pendant is attached to any one of the intermediate boom sections.

* * * * *